United States Patent [19]

Pollitt et al.

[11] 4,312,078

[45] Jan. 26, 1982

[54] HELMET WITH PIVOTABLE VISOR

[75] Inventors: John M. Pollitt; Dennis M. Hill, both of Stranraer, Scotland

[73] Assignee: Kangol Helmets Limited, Stranraer, Scotland

[21] Appl. No.: 124,108

[22] Filed: Feb. 25, 1980

[30] Foreign Application Priority Data

Feb. 26, 1979 [GB] United Kingdom ..... 06665/79

[51] Int. Cl.[3] ..... A42B 3/02

[52] U.S. Cl. ..... 2/424; 2/10

[58] Field of Search ..... 2/10, 424, 6, 9, 427

[56] References Cited

U.S. PATENT DOCUMENTS 4,242,757 1/1981 Nava ..... 2/10

FOREIGN PATENT DOCUMENTS 1034701 7/1978 Canada ..... 2/424

2326156 4/1977 France ..... 2/424

*Primary Examiner*—Peter P. Nerbun

*Attorney, Agent, or Firm*—Young & Thompson

[57] ABSTRACT

A motor cyclist's helmet has a visor apertured at either side so that it can pivot on pivots projecting from the helmet. At one side, the aperture in the visor is elongate so that this side of the visor can be pushed forward, the visor being slightly deformed outwardly. A pin projecting from the helmet and received in a slot in the visor then permits the visor to be pivoted upwardly, which the pin and slot prevents when the visor is pushed back against the helmet. The visor can be operated by one hand, with the help of a projecting portion of the visor or a gripping member affixed thereto.

10 Claims, 6 Drawing Figures

FIG.1.
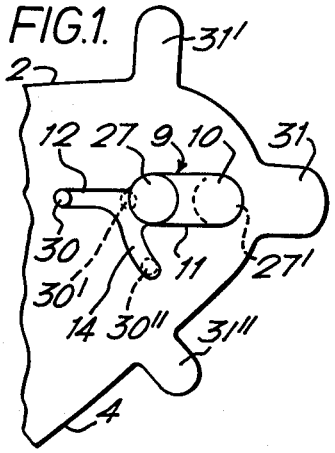
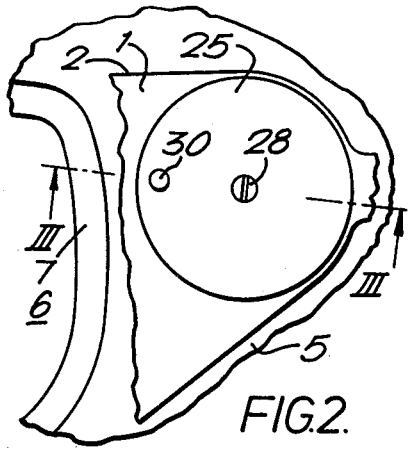
FIG.2.
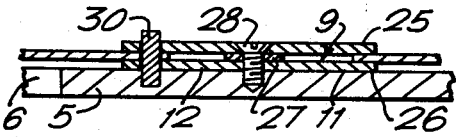
FIG.3.
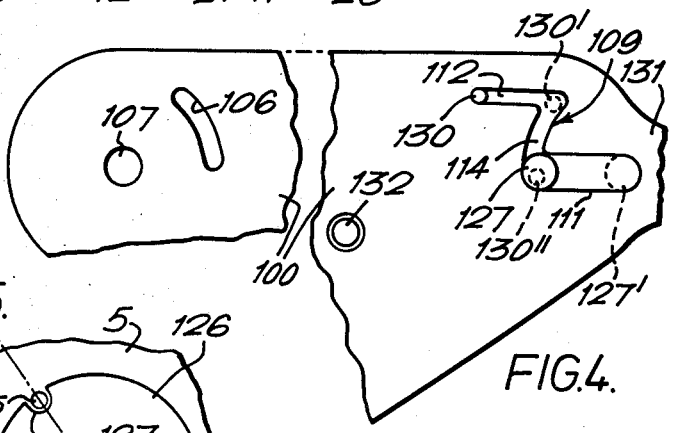
FIG.4.
FIG.5.
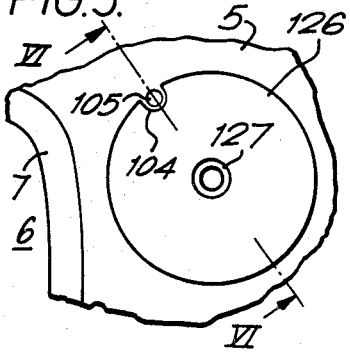
FIG.6.
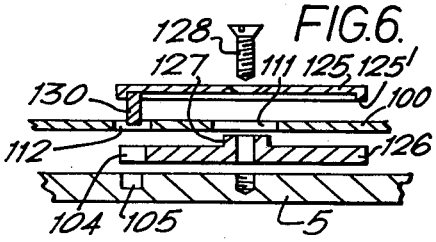

HELMET WITH PIVOTABLE VISOR

BACKGROUND OF THE INVENTION

The invention relates to a helmet mounting a visor, for example a protective helmet of the kind worn by motorcyclists.

Motorcyclists' safety helmets, particularly those of the full face type, are provided with a visor which is movable between a closed position covering the eye aperture of the helmet and an open position in which the aperture is exposed. Movement of the visor between these positions frequently presents considerable manipulative difficulties. For example, it is in many instances necessary to release one or more press studs and, after pivotation and realignment, to refasten them. The visor frequently has to be manipulated at both sides so that either both hands must be used, which represents a considerable inconvenience because of the need for a motorcyclist to keep one hand on the throttle, or one hand must be used to operate on the two sides of the visor in sequence.

It is thus an object of the invention to provide arrangements for mounting a visor on a helmet which provide for simple and convenient operation of the visor.

It is a further object of the present invention to provide visor mounting arrangements on a helmet which permit movement between visor open and visor closed positions by operation at one side only.

It is an additional object of the invention to provide visor mounting arrangements on a helmet which permit the visor to be opened and closed by manipulation at one side only and which permit this side to be conveniently changed.

SUMMARY OF THE INVENTION

The invention provides a visor mounting arrangement for a helmet in which the visor is pivoted to the helmet body by two spaced pivot means, at least one of which permits movement of the visor in the closed position thereof away from the helmet body, such movement effecting release of a latch device to permit pivoting of the visor to an open position.

The visor pivot means advantageously provide frictional restraint against at least the pivoting movement so that the visor is held in any desired intermediate position between the open and closed positions.

Preferably, the forward movement brings the visor to a position relative to a latch or guide pin fixed on the helmet such that the pin, which previously engaged the visor to prevent pivoting thereof, can enter an arcuate slot in the visor as this pivots upwardly to the open position.

The visor, pivots and guide pin can readily be constructed so that the visor can be mounted with its operative side to the left or right of the helmet as desired. The visor can be shaped so as to have one or more portions arranged to be conveniently engaged by the user's fingers or can have a separate member for this purpose attached to it.

DESCRIPTION OF THE DRAWINGS

FIG. 1 is a partial front view of a visor for use in a first helmet embodying the invention, parts of a pivot and latch device carried by the helmet body being also shown;

FIG. 2 is a partial front view of the helmet body with the visor secured thereto;

FIG. 3 is a fragmentary cross-sectional view on the line III—III of FIG. 2;

FIG. 4 is a partial developed front view of a visor for use in a second helmet embodying the invention, with parts of a pivot and a latch device carried by the helmet body being also shown;

FIG. 5 is a front view of part of a helmet body of FIG. 4, showing part of the pivot device; and FIG. 6 is a sectional view of the pivot device, with parts spaced away from each other, taken on the line VI—VI on FIG. 5.

In the drawing, the visors are thin flexible transparent sheet members of generally conventional shape for covering an eye aperture 6 in the body 5 of a motorcyclist's helmet, typically, but not necessarily, of the full face type.

The visor 1 of FIGS. 1 to 3 thus has an upper edge 2 following a shallow concave curve and a lower edge 4 which is deeply convex. Between these edges are rounded ends at least approximately centred on axes about which the visor can pivot in use on the helmet body 5 between closed and open positions respectively covering and exposing the eye aperture 6. The visor 1 is of course curved around the front of the helmet body in use. At the wearer's right hand side (not shown) the visor has a circular aperture centred on the associated axis but on the left hand side an aperture 9 has a similarly centred semicircular end portion 10 which extends towards the other side of the visor into a parallel sided portion 11. The portion 11 communicates with an axially aligned narrower portion 12 and an arcuate portion 14 centred on the axis extends downwardly from the join of the portions 11 and 12. The portion 14 is of substantially the same width as the portion 12 and these portions form part of a latch device.

At the left hand side, the visor 1 is located between an outer and an inner disc 25,26 of a pivot device. A pivot disc 27 between the discs 25,26 is received in the aperture portion 11. The discs 25,26 and 27 are secured to the helmet wall (shown flat although it will be somewhat curved in actuality) by a screw 28 extending into the wall through central apertures in the discs. A latch or guide pin 30 is anchored in the helmet wall and extends outwardly through aligned apertures in the discs 25,26 and through the aperture 9, to co-operate with the portions 12,14 to form the latch device.

The pivot and latch devices are thus combined but could be spaced apart and independent.

At the right hand side, a generally similar pivot device, without the pin 30, comprises fixed outer and inner discs, a pivot disc and a screw, the pivot disc being received in the circular aperture of the visor. The inner and outer discs at each side frictionally engage the visor 1 so that it tends to remain at any intermediate position between the closed and open positions to which it is moved.

In the closed position of the visor 1, the pin 30 and disc 27 occupy the positions shown in solid line in FIG. 1 at the extreme inner ends of the aperture portions 12 and 11 respectively. The pin 30 and aperture portion 12 then act as a latch device to latch the visor against opening movement to expose the eye aperture 6.

To open the visor 1, its left hand end is manually pushed forward against the frictional engagement with the discs 25,26. A tag portion 31 of the visor, which could be provided at 31' and 31'' instead or as well, facilitates this translational movement. When this movement ends, the visor 1 is in an intermediate closed position with the pivot disc 27 at the end portion 10 of the aperture 9, as shown in broken line and indicated by reference numeral 27' in FIG. 1. The guide pin 30 is now at the join of the aperture portions 11 and 12, as shown in broken line and indicated by reference numeral 30', and its axis is on the center line of the arcuate aperture portion 14.

There is of course no corresponding movement at the other side of the visor 1 which becomes slightly spaced away from the body 5 between the pivot devices by being slightly outwardly flexed. The visor 1 is thus cleared from the engagement with the body 5 around the eye aperture 6 and can be pivoted upwardly. The pivotal movement is limited by engagement of the pin 30 by the lower end of the aperture portion 14, the pin then having the position relative to the visor indicated in broken line and by reference numeral 30''.

It will be noted that the entire movement can be effected from the left hand side of the visor.

Return movement of the visor 1 to the closed position is effected by pivoting the visor to bring the pin 30 out of the aperture portion 14 and then by movement of the visor back against the helmet. As soon as the pin 30 enters the aperture portion 12 the visor is latched into its closed position. The return movements can be carried out without use being made of the tag 31 if preferred, as the visor can be manually tilted down by engagement by the hand for example at a position along the upper edge 2 and brushed back to effect latching by engagement of its outer surface adjacent the left hand end. The return translational movement may also tend to take place as a consequence of wind pressure if the wearer drives at a sufficient speed, depending on the frictional resistance to such movement imposed by the discs 2,26.

In the helmet of FIGS. 4 to 6, the visor 100 has at the lefthand side an aperture 109 with a parallel sided portion 111 corresponding to the portion 11 of the visor 1, and a narrower parallel sided portion 112 extending parallel to the portion 111 and joined with it by an intermediate arcuate portion 114.

The associated pivot device comprises a lower disc 126 and with a central boss 127 protruding outwardly into the aperture 111. An outer disc 125 is assembled on the outer surface of the visor 100 and engages it by way of a peripheral rim 125'. A latch or guide pin 130 protrudes from the periphery of the disc 125 through the aperture 109, a peripheral recess 104 in the disc 126, and into a hole 105 in the helmet body 5. The discs 125,126 are secured to the helmet body 5 by a screw 128, and held against rotation by the screw and the pin 130. The pin 130 could instead be carried by the disc 126. The pin need not extend into a hole in the helmet body, the disc 126 being then secured to the helmet body by other means.

The boss 127 and the pin 130 function in relation to the aperture 109 in the same way as the pivot pin disc 27 and the pin 30 function in relation to the aperture 9 of the visor 1. Thus, from the normal closed positions of the boss 127 and pin 130 relative to the visor, these move to the locations shown by reference numerals 127' and 130' with the translational outward movement of the visor, and the pin moves to the location 130'' with the upward pivotal movement to the open position.

At the righthand side of the visor 100, a like pivot device is provided, the boss 127 of which is received in a circular aperture 107 in the visor, and the guide pin 130 of which is received in an arcuate visor aperture 106 centered on the aperture 107. The aperture 106 shares with the aperture portion 114 the function of limiting pivotal movement of the visor on the helmet body.

Although it is preferred to arrange for operation of the visor from the left hand side of the helmet, because the wearer may be retaining hold of a motorcycle throttle with his right hand while moving the visor, it will be evident that operation from the right hand side can readily be provided for. With the helmet of FIGS. 1 to 3, if provision is made for reception of the guide pin 30 at either side of the helmet, the arrangements described can be readily changed from operation at one side to operation at the other, the visor being sufficiently flexible to be reversible.

The helmet of FIGS. 4 to 6 facilitates such a change because the pivot devices are alike and only reversal of the visor is required. A pin and co-operating aperture corresponding to aperture 106 in the visor 100 could be employed in the helmet of FIGS. 1 to 3 if desired.

Although the use of similar pivot elements at the two sides of the visor is convenient, it will be understood that different pivot means can be employed at the two sides, particularly when the facility of selecting the side from which operation takes place is not to be provided. The mounting at the other side can thus be a simple bearing or pivot pin, and can then make no substantial contribution to the frictional restraint of the visor movement.

Where visor reversal is not contemplated, one or more tags such as the tag 31 can be made to extend outwardly away from the adjacent surface of the visor, and/or a separate element, for example a rivet can be secured to extend outwardly from the visor as shown at 132 on FIG. 4. Reversability can however be retained if such an element is secured in a hole in the visor in such a way that it can be readily arranged to extend outwardly to one side or the other, as desired.

We claim:

1. A helmet comprising body means, an eye aperture in said body means, first and second pivot means, visor means mounted on said body means by said pivot means for opening pivoting movement from a closed position closing said eye aperture, at least one of said first and second pivot means comprising first pin means in one of said body means and said visor means and an elongate first recess in the other of said body means and said visor means, said first recess receiving said first pin means therein and cooperating therewith to permit translational movement of said visor means towards and away from said body means when said visor means is in said closed position, second pin means on one of said body means and said visor means and a second recess in the other of said body means and said visor means, said second recess receiving said second pin means and having a single elongate portion accommodating said translational movement and an adjoining arcuate portion accommodating said pivoting movement from said closed position of said visor means when said visor means has been translationally moved away from said body means, and frictional means operative between said body means and said visor means frictionally opposing said pivotal movement, whereby said visor means when moved toward said body means in said closed position is latched in place by cooperation of said single elongate portion of said second recess with said second pin means and can be unlatched by said translational movement away from said body means and then pivoted from said closed position to a desired open position, with relative movement of said second pin means and said arcuate portion of said second recess, said frictional means retaining said visor means in said desired open position.

2. The helmet of claim 1 wherein said visor means is constructed of sheet-like material, said first and second recesses comprise respective first and second slots formed through said visor means, and said pin means project outwardly from said body means into said slots.

3. The helmet of claim 2 wherein said elongate portion of said second slot is narrower than said first slot and forms an axial continuation thereof, said arcuate portion of said second slot extending from the end of said second slot remote from said first slot.

4. The helmet of claim 2 wherein said second slot is narrower than said first slot and said elongate portion of said second slot extends in parallel spaced relation to said first slot, said arcuate portion of said second slot extending between said elongate portion and said first slot.

5. The helmet of claim 2 wherein said frictional means comprises inner and outer disc means at at least one of said pivot means, said disc means having said visor means frictionally received therebetween.

6. The helmet of claim 5 having said inner and outer disc means at said at least one of said pivot means and wherein said second pin means is carried by one of said disc means.

7. The helmet of claim 6 wherein said inner disc means has an aperture spaced from said first pin means, said helmet body means has a recess and said second pin means extends from said outer disc means through said inner disc means aperture into said body means recess.

8. The helmet of claim 7 wherein said visor means material is flexible, said helmet body means is adapted to have said second pin means in a selected one of two positions for reception in said second slot respectively with one or other side of said visor means adjacent said helmet body means.

9. The helmet of claim 5 wherein said first pin means comprises a central boss on one of said disc means.

10. The helmet of claim 1 wherein said first and second pin means and recesses are provided at one only of said first and second pivot means, and said frictional means are associated with each of said first and second pivot means.

* * * * *